US006382107B1

(12) United States Patent
Schmitz et al.

(10) Patent No.: US 6,382,107 B1
(45) Date of Patent: May 7, 2002

(54) RAIL-MOUNTED TRANSPORTING DEVICE FOR ULTRA-HEAVY LOADS

(75) Inventors: Günter Schmitz, Duisburg; Günter Gruna, Oberhausen, both of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/807,347

(22) PCT Filed: Jun. 9, 1999

(86) PCT No.: PCT/DE99/01716

§ 371 Date: May 30, 2001

§ 102(e) Date: May 30, 2001

(87) PCT Pub. No.: WO00/21816

PCT Pub. Date: Apr. 20, 2000

(30) Foreign Application Priority Data

Oct. 12, 1998 (DE) ..... 198 48 295

(51) Int. Cl.[7] ..... E01B 25/00

(52) U.S. Cl. ..... 104/130.07; 104/130.01; 104/27

(58) Field of Search ..... 104/27, 29, 31, 104/35, 40, 130.01, 130.07

(56) References Cited

U.S. PATENT DOCUMENTS 1,094,026 A * 4/1914 Simmonds ..... 104/35
4,757,767 A * 7/1988 Wesselski et al. ..... 104/35
4,875,415 A * 10/1989 Kasugai ..... 104/35
5,857,413 A * 1/1999 Ward ..... 104/130.01
5,957,055 A * 9/1999 Bauer et al. ..... 104/35

* cited by examiner

*Primary Examiner*—Mark T. Le
(74) *Attorney, Agent, or Firm*—Cohen, Pontani, Lieberman & Pavane

(57) ABSTRACT

A rail-mounted transport device for ultra-heavy loads, in particular for changing steel mill converters includes a vehicle which accepts the load independently and is guided on tracks to a delivery station via a turning station where the transport direction is changed, in particular by 90°. The vehicle frame has an annular component for accepting the load, at least three turning wheels provided at the periphery of the annular component, and transport wheels arranged on the vehicle frame, wherein the transport wheels and/or the turning wheels are adjustable in height by means of adjusting elements. The adjusting elements are connected to actuators which can be brought into a position above the vehicle frame in which the transport wheels are raised from the rails during turning. Motors drive the turning wheels to rotate the vehicle frame from the previous transport direction into the desired transport direction.

11 Claims, 6 Drawing Sheets

RAIL-MOUNTED TRANSPORTING DEVICE FOR ULTRA-HEAVY LOADS

BACKGROUND OF THE INVENTION

1. Field of the Invention

The invention relates to a rail-mounted transport device for ultra-heavy loads, in particular for changing steel mill converters, using a vehicle which accepts the load independently and is guided by rails on the way to the delivery station, the transport direction of which rails is altered at a turning station, in particular by 90°.

2. Description of the Related Art

A transport car is known, from DE-AS 24 04 868, to which U.S. Pat. No. 3,942,453 corresponds, on which an elongated essentially cylindrical vessel is supported and in which drives arranged laterally on the vessel, together with the gripping means provided on the vessel shell, form a structural unit which remains in one piece when the vessel is raised from the bogies.

The axis of rotation of this vessel, which is designed as a raw iron mixer, is parallel to the main axis of the transport car.

At the "21$^{st}$ Century Steel Industry of Russia and CIS" conference from June 6 to June 10, 1994 in Moscow, a converter change system was presented. From this, a converter change vehicle (essentially Example 2.3 and FIG. 13) is known in which the converter is deposited on a plate rotatably supported in the bogie. Below this plate, piston/cylinder units are provided which are extended at a predetermined vehicle distance and provide the possibility of rotating the bogie in its direction and of depositing the wheels on the desired rail track after the rotation.

The disadvantage of this converter change vehicle is not only the relatively complicated design and maintenance-intensive live ring but also the total installation height of the vehicle.

SUMMARY OF THE INVENTION

The invention therefore has the object of creating, with simple design means, a transport device for ultra-heavy loads, in particular for a steel mill converter, which device demands as small as possible a clear height along its transport path.

The invention achieves this objective by means of the method claim 1 and the appliance claim 3. The other claims form advantageous developments of the invention.

According to the invention, the load is lowered as deeply as possible into the vehicle frame after it has been accepted by the rail-mounted transport device. Because of the given design features of the shops, turning points are necessary between the acceptance station and the delivery station. According to the invention, the load is kept at an almost identical level at these turning points and the force is transferred from transport wheels, which correspond to the straight rail tracks, to turning wheels which correspond to a rail with a circular path. At this turning station, the whole transport device is turned and, after reaching the new direction of travel, is deposited onto the transport wheels again on the rail track.

The crossing points of the rails are then designed in such a way that the acceptance of the force changes from the wheel running surface and the rail running surface to the wheel flanges and the rail foot.

Because the load is lowered as deeply as possible into the vehicle frame of the transport device, it is possible to pass under obstacles such as crane track carriers or platforms, the greatest dimension arising from the addition of the vessel height to the necessary clearance dimension between converter bottom and foundry floor.

In advantageous designs, two wheels are combined in each case to form a wheel unit, which wheels are then arranged on links. An adjustment device for setting the necessary height relative to the bogie is arranged at a respective end of each link. Force compensation elements, essentially springs, are arranged between the adjusting elements and the links for the uniform distribution of the force.

In an advantageous configuration of the transport wheels relative to the vehicle frame, spindles are provided at the ends of the links inclined toward one another, which spindles are connected to the vehicle frame by means of a rocker.

For the exact acceptance of the high forces here present and for exact centering, the rail support surface of the rail track with the circular path is inclined, in one configuration, in proportion to the radius toward the center of the circle.

In order to avoid interruptions in the force acceptance, the rail foot and the rail contact surface are configured at the crossing points in such a way that parts of the rails are configured as falling wedges and as rising wedges at the corresponding positions of the rail foot.

Due to the constant acceptance of the force, it is possible to keep the load, essentially a steel mill converter in the present case, continuously in the same horizontal position and therefore at the deepest point in a steel mill shop. In this way, costly design complications, in particular with respect to the crane track heights and/or the rail position, are avoided.

DETAILED DESCRIPTION OF THE PREFERRED EMBODIMENTS

Figure 1:
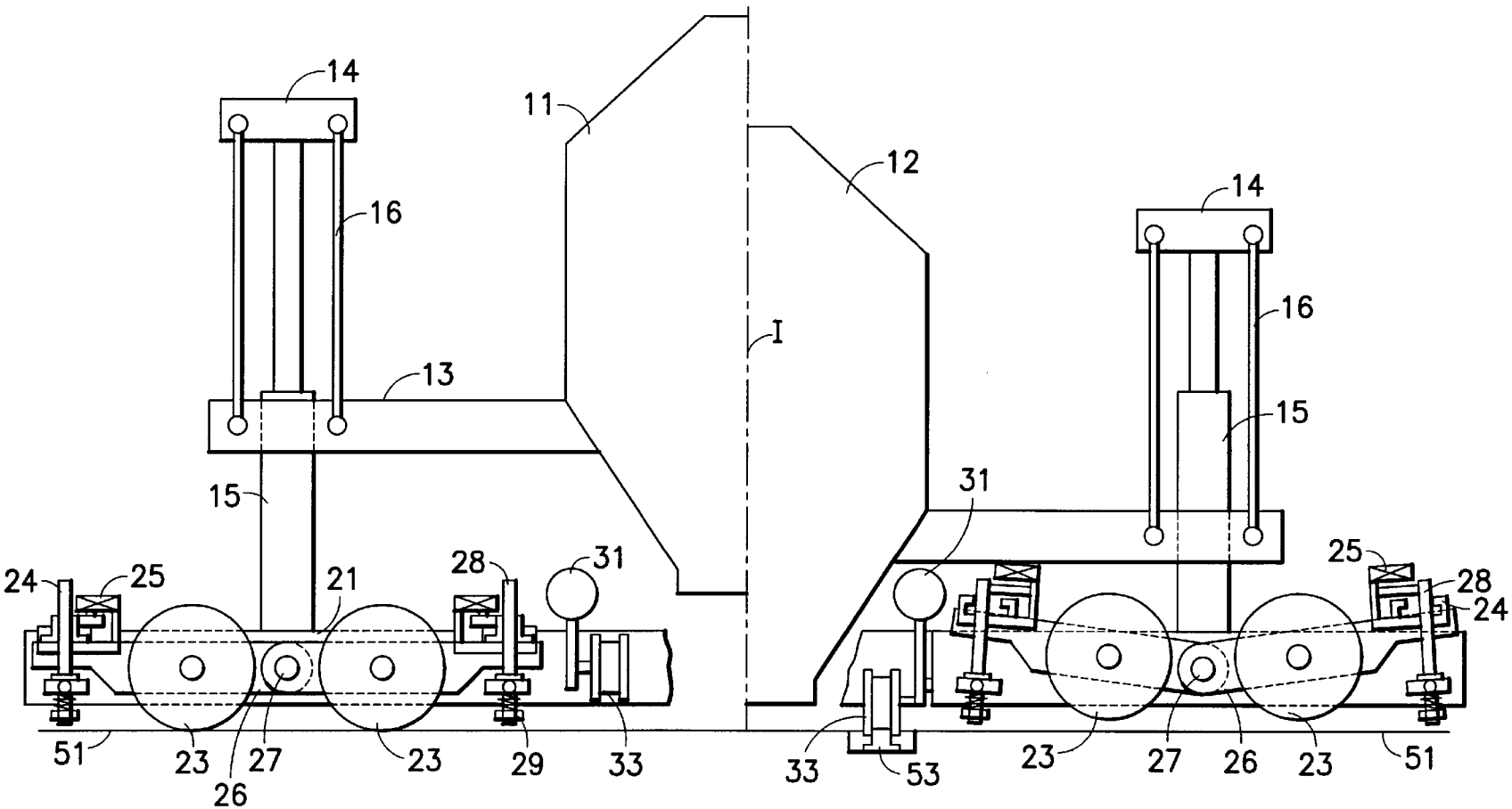
FIG. 1 shows a side view of the transport device.

In the left-hand part of the figure, FIG. 1 shows how a load 11 is accepted by a support frame 13, which is connected by means of holding rods 16 and a cross beam 14 to a piston/cylinder unit 15 and, corresponding to the representation of the right-hand part of the figure, is lowered as deeply as possible into the vehicle frame 21 of the transport device. Both the transport wheels 23 and the turning wheels 33 are attached to the vehicle frame 21.

In the left-hand part of the figure, the turning wheel 33 is raised and the transport wheels 23 are in contact with the rail 51. In this arrangement, the transport wheels 23 are centrally connected to links 26, which are rotatably supported at the facing ends on a pivot pin 27 and are connected to an adjusting element 24 at their ends pointing away from one another. This adjusting element 24 has a spindle 28 which can be driven by an actuator 25. A force compensation element, a spring in this case, is arranged between the spindle 28 and the vehicle frame 21.

The height of the turning wheels 33 is adjustable by means of a motor 31. In the right-hand part of the figure, the turning wheels 33 are lowered onto the rail track 53 with the circular path. The links 26 have been adjusted by the adjusting elements 24 to such an extent that the transport wheels 23 have been released from the rail 51. In this position, the whole of the transport device can be turned about the center line 1.

Figure 2:
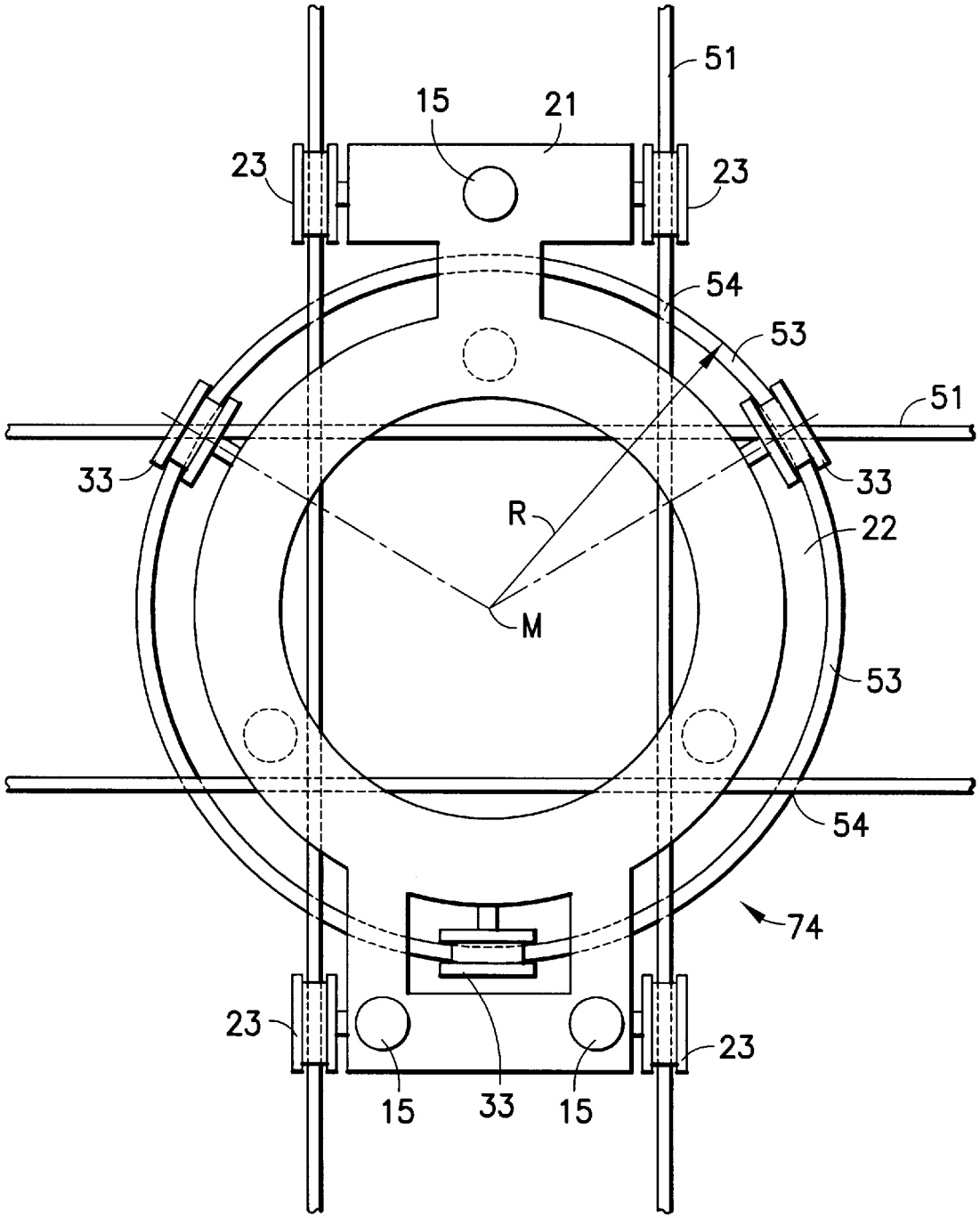
FIG. 2 shows a plan view of the transport device.

FIG. 2 shows, in plan view, the vehicle frame 21 which has an annular component 22 in the center. Three turning wheels are fastened to the annular component 22 and are evenly distributed about the periphery. The rest of the frame 21 is designed in such a way that transport wheels 23 can be attached in both the front and the rear part of the vehicle and, at the same time, space is left for possible turning wheels 33 and, in addition, support points for the piston/cylinder units 15 for accepting the support frame.

Figure 3A:
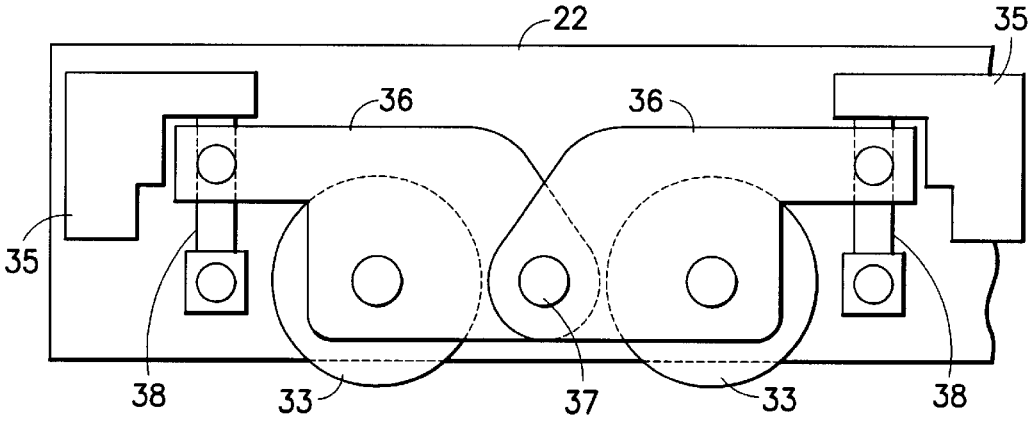
FIG. 3*a* is a side view of a wheel unit of turning wheels.

In FIG. 3*a,* a part of the annular component 22 of the vehicle frame is shown as excerpt. A pivot pin 37 is fastened to this component 22. Two links 36, each comprising a pair of link arms which carry a turning wheel 33 therebetween, are rotatably supported on the pivot pin 37. Spindles 38 are fastened to the ends of the links 36 which face away from one another. These spindles can be driven by means of an actuator 35 and adjust the links 36 and therefore the wheels 33 relative to the annular component 22.

Figure 3B:
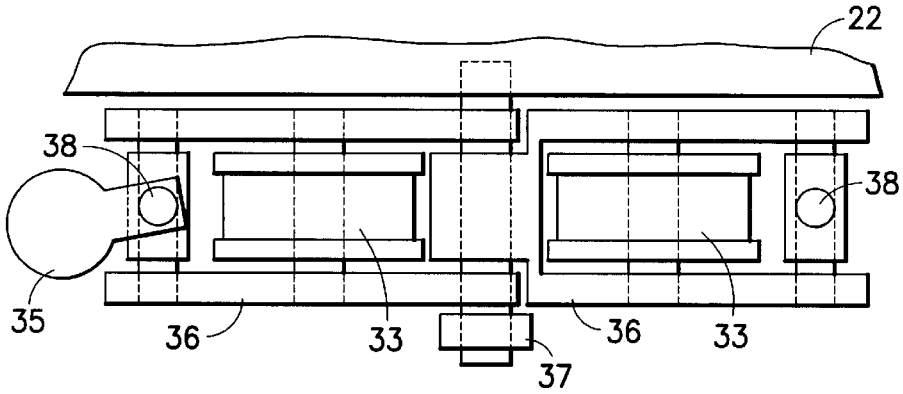
FIG. 3*b* is a plan view of a wheel unit of turning wheels.

The plan view of the wheel unit with the turning wheels 33 is shown in FIG. 3*b.*

Figure 4:
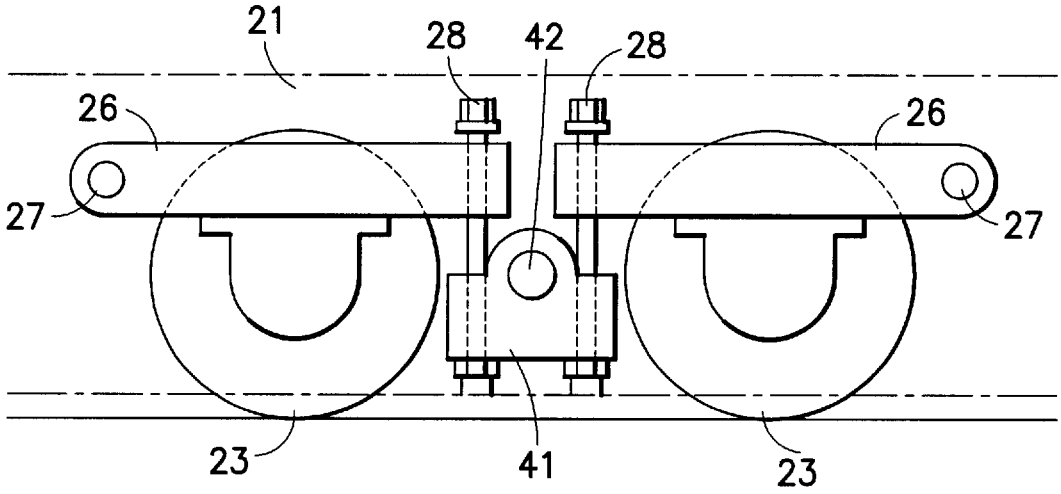
FIG. 4 is a side view of a wheel unit of transport wheels.

FIG. 4 shows a wheel unit with transport wheels 23, which are arranged on links 26. The links 26 are rotatably supported on pivot pins 27 attached to the vehicle frame 21. At the mutually facing ends of the links 26, spindles 28 are provided which correspond to a rocker 41, which is fastened to the vehicle frame 21 by means of a pin 42.

The design of the rails in the region of a crossing point 54 is shown in FIG. 5.

Figure 5A:
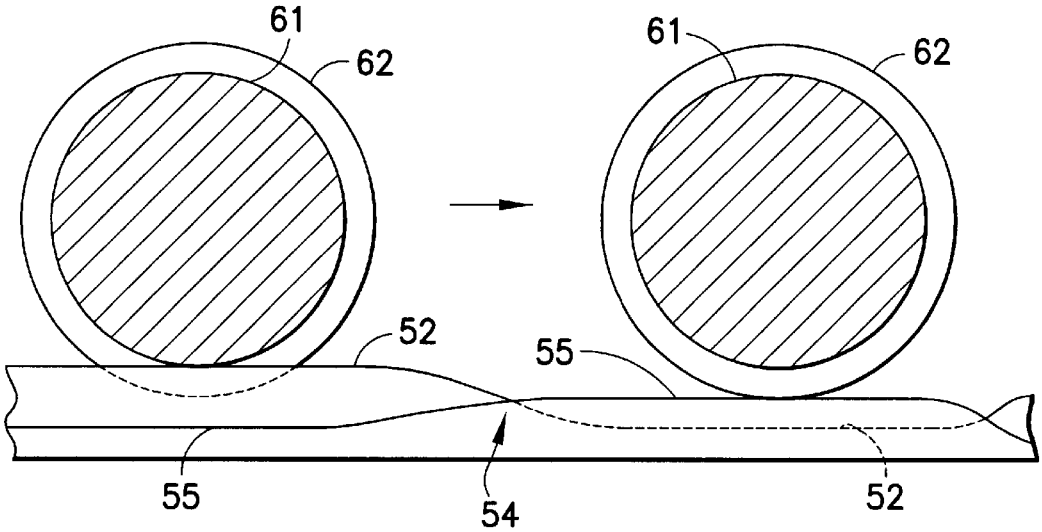
FIG. 5*a* is a side view of a rail intersection.

In FIG. 5*a,* the wheel running surface 61 of the transport wheel 23 or of the turning wheel 33 is located on the rail contact surface 52. The wheel flange 62 is at a distance from the rail foot 55.

After a transition section, in the right-hand part of the figure, the wheel running surface 61 is at a distance from the rail contact surface 52 and the wheel flange 62 is located on the rail foot 55.

Figure 5B:
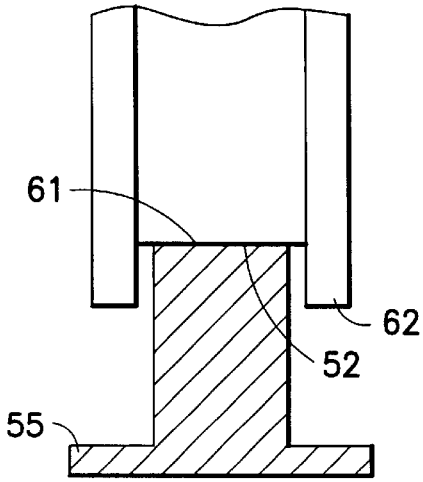
FIG. 5*b* is a cross-section of a rail remote from the intersection.
Figure 5C:
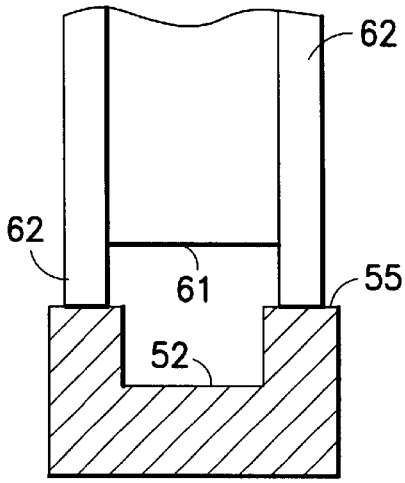
FIG. 5*c* is a cross-section of a rail in the intersection.

The situation on the left-hand side of FIG. 5*a* is again shown in section in FIG. 5*b,* the figure showing the normal operation in which the wheel running surface 61 is in contact with the rail contact surface 52. In the region of the crossing point 54, as is shown in the right-hand part of FIG. 5*a* and in FIG. 5*c,* the full load of the transport device is accepted by means of the wheel flange 62 and the rail foot 55 for a relatively short distance.

Figure 6:
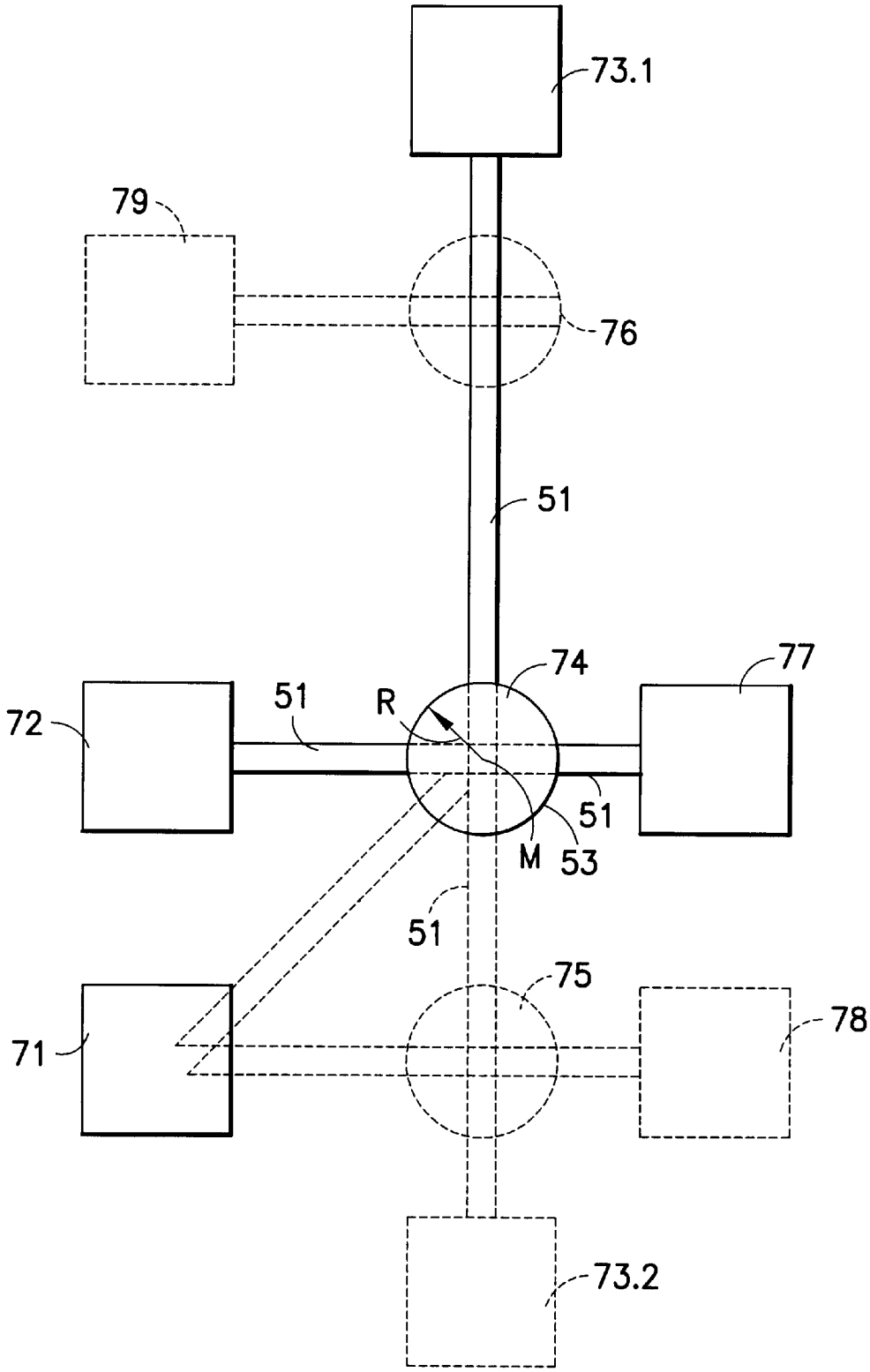
FIG. 6 shows arrangement of the stations.

The acceptance stations 71, 72 on a converter installation in a steel mill are shown in FIG. 6. When a converter is changed, the converter is taken by a transport vehicle from a working location in the acceptance region 72 and conveyed to a parking station 77 (or, if appropriate, 79). The vehicle then takes a repaired converter from the delivery station 73, transports the converter to a turning station 74, where the vehicle undergoes a change in direction, and transports the load to the acceptance station 72. The converter which has been changed is then taken from the parking station 77 and transported to the delivery station 73.

Overall, at least one turning station 74 is necessary. From this, the rail tracks 51 lead to the acceptance station 71 and 72, and to the parking station 77 and to the delivery station 73.

Depending on the shop situation and the convenience level of the equipment of the steel mill shop, a rail track 51 is routed parallel to the operating position acceptance stations 71, 72 and a possible parking station 79, in the present FIG. 6. At the ends of this rail track 51, delivery stations 73.1 and 73.2 are shown, still further parking stations 77 and 78 being arranged opposite to the acceptance stations 71 and 72.

What is claimed is:

1. A method for transporting heavy loads, comprising the following steps a) providing a transport vehicle for transporting the load, said transport vehicle comprising a vehicle frame, transport wheels carried by said frame, and turning wheels carried by said frame, b) guiding said transport vehicle on a first parallel rail track by means of said transport wheels until said vehicle is centered over a second parallel rail track which intersects said first parallel rail track, and a circular track which is intersected by said first and second parallel rail tracks, c) bringing said turning wheels into contact with said circular track, d) raising said transport wheels vertically from said parallel rail track, e) moving said vehicle on said circular track until said transport wheels are aligned with said second parallel rail track, f) bringing said transport wheels into contact with said second parallel rail track, g) raising said turning wheels from said circular track, and h) guiding said transport vehicle on said second parallel rail track by means of said transport wheels.

2. A method for transporting heavy loads as in claim 1 wherein each of said wheels is provided with a rolling surface and a flange, said tracks being profiled so that, where each said track intersects another said track, the force transmission from a wheel to the track which the wheel is in contact with changes from the rolling surface to the flange and vice versa.

3. A transport installation for transporting heavy loads, said installation comprising a rail installation comprising a first parallel rail track, a second parallel rail track which intersects said first parallel rail track, and a circular rail track which is intersected by said first and second parallel rail tracks at a turning station, and a transport vehicle comprising a vehicle frame having an annular component for accepting a load, at least three turning wheels carried on the circumference of said annular component, said turning wheels corresponding to said circular track, at least four transport wheels carried on said frame, said transport wheels corresponding to said parallel rail track, height adjusting means for adjusting the height of at least one of said turning wheels and said transport wheels, and motors for driving said turning wheels so that said vehicle frame can be rotated.

4. A transport installation as in claim 3 wherein said height adjusting means comprises links on which said wheels are mounted, and actuators for pivoting said links so that said wheels move vertically.

5. A transport installation as in claim 4 wherein at least one of said transport wheels and said turning wheels is carried by wheels units, each said wheel unit comprising a pair of said links, each of said links having one end which pivots about a pivot pin fixed to said vehicle frame, each said link comprising a pair of link arms which carry one of said wheels therebetween, said height adjusting means further comprising a spindle at the other end of each said link, said spindles being driven vertically by said actuators.

6. A transport installation as in claim 5 wherein each said wheel unit further comprises a force compensating element on each of said spindles.

7. A transport installation as in claim 5 wherein said one ends are mutually opposed and pivot about respective pivot pins fixed to said frame, said other ends being mutually facing, said spindles being fixed to a common rocker which is connected to the vehicle frame by a pin.

8. A transport installation as in claim 3 wherein said circular track has a radius and a rail contact surface, said rail contact surface being inclined in proportion to said radius.

9. A transport installation as in claim 3 wherein each said wheel has a running surface and at least one flange, said parallel rail tracks and said circular rail track comprising rails, each said rail having a contact surface and a foot, said contact surface being higher than said foot and supporting said running surface remote from where said tracks intersect, said contact surface comprising a falling ramp and said foot comprising a rising ramp proximate to where said rails intersect, whereby said wheel flange is supported on said foot where said tracks intersect.

10. A transport installation as in claim 3 wherein said first parallel rail track serves at least one delivery station and said second parallel rail track serves an acceptance station and a parking station.

11. A transport installation as in claim 10 further comprising an additional turning station, a respective additional second parallel rail track, and a respective additional acceptance station, said first parallel rail track passing through both of said turning stations.

* * * * *